US006483471B1

(12) United States Patent
Petros

(10) Patent No.: US 6,483,471 B1
(45) Date of Patent: Nov. 19, 2002

(54) COMBINATION LINEARLY POLARIZED AND QUADRIFILAR ANTENNA

(75) Inventor: Argy Petros, Lake Worth, FL (US)

(73) Assignee: XM Satellite Radio, Inc., Washington, DC (US)

( * ) Notice: Subject to any disclaimer, the term of this patent is extended or adjusted under 35 U.S.C. 154(b) by 0 days.

(21) Appl. No.: 09/875,728

(22) Filed: Jun. 6, 2001

(51) Int. Cl.[7] ..... H01Q 21/00

(52) U.S. Cl. ..... 343/725; 343/791; 343/821; 343/895

(58) Field of Search ..... 343/725, 726, 343/727, 728, 729, 730, 700 MS, 741, 791, 866, 895, 821

(56) References Cited

U.S. PATENT DOCUMENTS 3,100,893 A * 8/1963 Brueckmann ..... 333/32
3,750,181 A * 7/1973 Kuecken ..... 343/790
4,963,879 A * 10/1990 Lin ..... 343/792
6,005,521 A * 12/1999 Suguro et al. ..... 343/700 MS
6,150,981 A * 11/2000 Suguro et al. ..... 343/700 MS

OTHER PUBLICATIONS

*Microwave Journal*, "A Combination Monopole/Quadrifilar Helix Antenna for S–Band Terrestrial/Satellite Applications", May 2001; McCarrick, Charles D.

* cited by examiner

*Primary Examiner*—Tan Ho
(74) *Attorney, Agent, or Firm*—Akerman Senterfitt

(57) ABSTRACT

A combination linearly polarized antenna and quadrifilar helix antenna (40) includes a quadrifilar antenna (49) having a first coaxial cable (46) and an antenna with linear polarization (44) external to the quadrifilar antenna and having a second coaxial cable (42). A center conductor of the second coaxial cable is isolated from a center conductor of the first coaxial cable and the first coaxial cable runs substantially concentrically through the antenna with linear polarization.

24 Claims, 8 Drawing Sheets

Combination Antenna Description

Dipole Description

"Tube" Dipole

Standard "Sleeve" Dipole

Multiple "Tube" Dipole Antennas

Combination Antenna Description

40

Balun Description

50

Dipole/QFILAR Combination

Alternative Implementation 1

60

Dipole/QFILAR Combination

Alternative Implementation 2

70

Quadrifilar-Dipole

Alternate Implementation 3

COMBINATION LINEARLY POLARIZED AND QUADRIFILAR ANTENNA

CROSS-REFERENCE TO RELATED APPLICATIONS (not applicable)

FIELD OF THE INVENTION

The invention relates generally to a combination satellite and terrestrial antenna, and more particularly to a combination linearly polarized and quadrifilar antenna able to provide excellent performance for both antennas.

BACKGROUND OF THE INVENTION

Charles D. McCarrick describes a combination monopole/quadrifilar helix antenna for S-band/Satellite applications on page 330 of the May 2001 edition of the Microwave Journal. FIG. 1 illustrates the monopole/quadrifilar antenna 10 discussed in the McCarrick article. The antenna 10 includes a monopole 15 whose reflective element is a quarter-wave choke 14. Elements 14 and 15 form dipole antenna 13. The antenna 10 comprises a coaxial line 12 with a section of the outer conductor removed to expose the center conductor 15. The quarter-wave choke 14 is placed within a quadrifilar helix antenna shell 16 in an axially concentric fashion. The quadrifilar helix antenna is typically phased to produce circular polarization. Appropriate placement of the dipole antenna 14 within the quadrifilar antenna is critical for avoiding coupling between the two antennas and avoiding degradation of radiation patterns.

A combined antenna as described above has the disadvantages of having strict design requirements in terms of relative placement between antennas to avoid interference between the antennas and further requires a wider overall structure that may not necessarily be aesthetically pleasing. It is very difficult to optimize due to interactions between the dipole and quadrifilar helix. Furthermore, it is a mechanically-challenging structure and difficult to manufacture. The typical placement for such a combined antenna would be on the sloping back windshield of a vehicle. In this instance, for good satellite reception, care must be taken to ensure that most of the quadrifilar antenna "clears" the line of sight with the transmitting satellite that may be blocked by the roof of the vehicle. Thus, a need exists for a combined dipole and quadrifilar antenna that will enable designers further freedom in the relative placement of the antennas while avoiding the detriments of coupling and interference between the antennas. Further, a need exists for a combined antenna that is esthetically pleasing that will further enable greater design choice in the placement of such combined antennas on windshields without being subject to blockage of signals by the form factor of the vehicle.

SUMMARY

In a first aspect of the present invention, a combination linearly polarized antenna and quadrifilar helix antenna comprises a quadrifilar antenna having a first coaxial cable and an antenna with linear polarization external to the quadrifilar antenna and having a second coaxial cable. A center conductor of the second coaxial cable is isolated from a center conductor of the first coaxial cable and the first coaxial cable runs substantially concentrically through the antenna with linear polarization.

In a second aspect of the present invention, a combination dipole and quadrifilar helix antenna comprises a quadrifilar antenna having a first coaxial cable and a dipole antenna external to the quadrifilar antenna and having a second coaxial cable. A center conductor of the second coaxial cable is isolated from a center conductor of the first coaxial cable and the second coaxial cable runs substantially concentrically through the quadrifilar helix antenna.

In a third aspect of the present invention, a combination linearly polarized antenna and quadrifilar helix antenna comprises a quadrifilar antenna and a linearly polarized antenna vertically aligned and external to each other. The combination antenna further comprises a first coaxial cable running substantially concentric within at least a portion of the combination linearly polarized antenna and quadrifilar helix antenna serving as a coaxial feed to a quadrifilar feed network for the quadrifilar antenna and a second coaxial cable running substantially concentric within at least a portion of the combination linearly polarized antenna and quadrifilar helix antenna and serving as a quarter-wave extension for the linearly polarized antenna.

In a fourth aspect of the present invention, a tubular dipole antenna comprises a coaxial cable having and an inner conductor and an outer conductor both running vertically and substantially concentrically through a quarter-wave metal sleeve. The tubular dipole antenna further comprises a shorted end formed from the connection of the outer conductor of the coaxial cable to an end of the quarter-wave metal sleeve and a quarter-wave hollow metal tube connected to the inner conductor of the coaxial cable extending from the end of the quarter-wave metal sleeve.

DETAILED DESCRIPTION OF THE DRAWINGS

Figure 4:
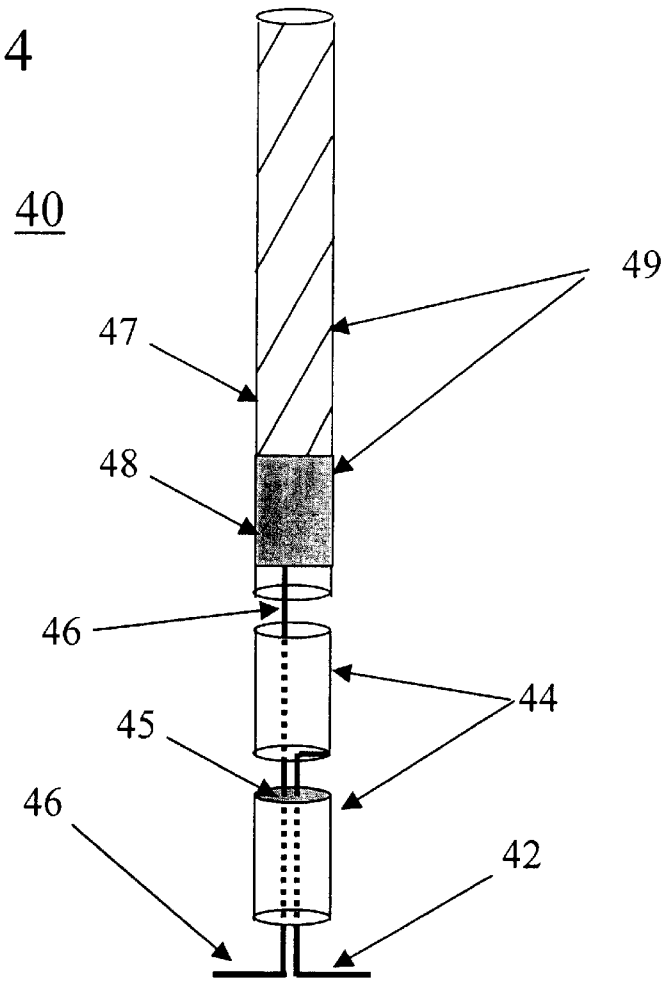
FIG. 4 is a diagram illustrating the combination of a quadrifilar and dipole antenna in accordance with the present invention.

A combination linearly polarized/quadrifilar helix antenna 40 is illustrated in FIG. 4. Preferably, it consists of a new tubular dipole antenna 44 that is placed coaxially underneath the quadrifilar helix, but it should be noted that other types of dipole antennas, patches, or loop antennas (being linearly polarized) could easily replace the tubular dipole antenna and still be within contemplation of the scope of the present invention. A (first) coaxial cable 46 is passed through the new tubular dipole with minimum effect on its performance. That coaxial cable 46 is connected to a feed network 48 of the quadrifilar helix antenna 49. It should be noted that feed network 48 and quadrifilar shell 47 form the quadrifilar hexlix antenna 49. A (second) coaxial cable 42 preferably couples to a quarter wave hollow metal tube coupled to an inner conductor of coaxial cable 42 forming the tubular dipole antenna 44. The outer conductor of cable 42 (shield) is physically connected to the outer conductor (shield) of cable 46 and both are also connected to the shorted top section of tube 45. This configuration results in excellent performance for both antennas. Coaxial cable 46 has a minimum effect on dipole 44 due to the dipoles tubular structure. Also, this configuration results in minimum interaction between quadrifilar antenna 49 and dipole 44.

Figure 2:
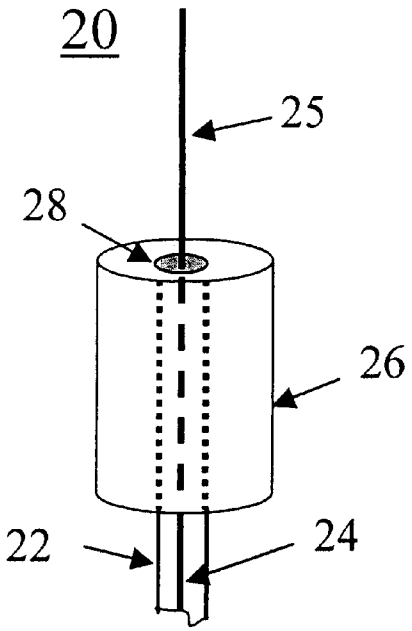
FIG. 2. illustrates a standard sleeve dipole as may be used in accordance with the present invention.

FIG. 2 provides a more detailed illustration of a commercial sleeve dipole 20. Preferably, the dipole 20 includes a coaxial cable 22 having an inner conductor 24. The coaxial cable 22 preferably runs vertically and concentrically through a quarter-wave metal sleeve 26 shorted at one end (top) and connected to the outer conductor (shield) of cable 22 at the shorted end. This structure is known as a balun. The balun is shown with a short 28 between an outer conductor of the coaxial cable 22 and the metal sleeve 26. The dipole 20 finally comprises a quarter-wave extension 25 of the inner conductor 24.

Figure 1:
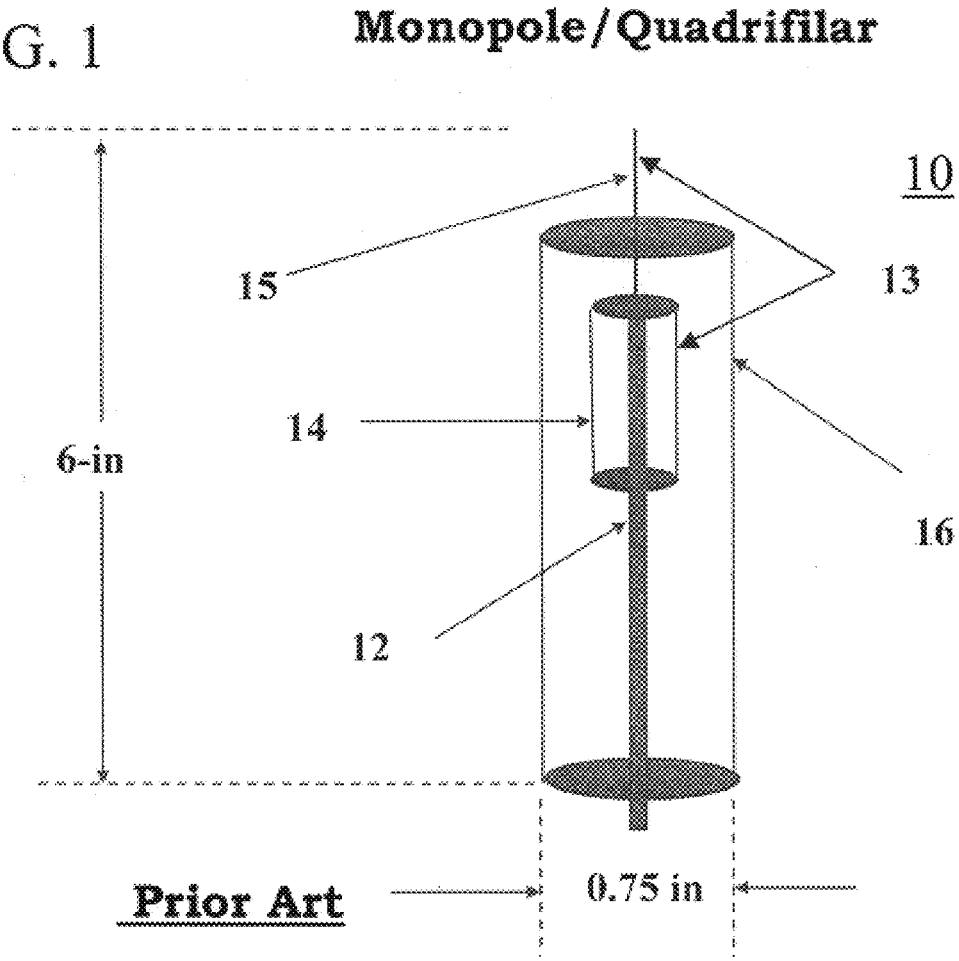
FIG. 1 illustrates an existing monopole/quadrifilar antenna.
Figure 3:
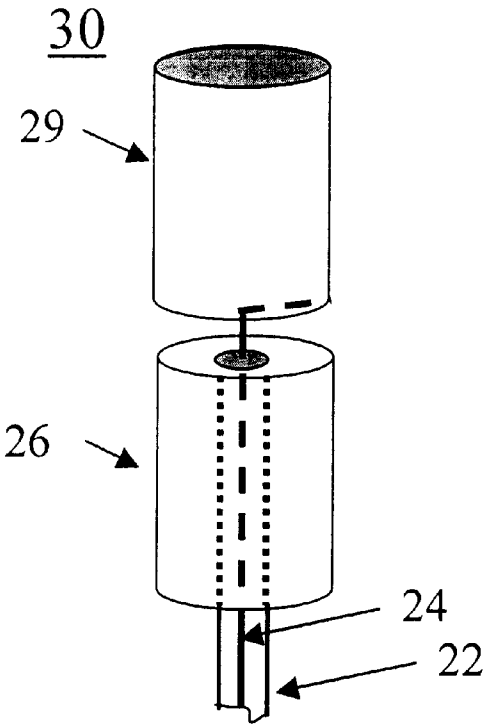
FIG. 3 illustrates a linearly polarized antenna in the form of a "tube" dipole with a quarter-wave hollow metal tube connected to a coaxial cable's inner conductor as may be used in accordance with the present invention.

FIG. 3 illustrates a sleeve dipole where conductor 25 of FIG. 2 is replaced by tube 29. Tubular dipole 30 preferably comprises coaxial cable 22, inner conductor 24, and the balun with the quarter-wave metal sleeve 26 as previously described with FIG. 2. In this instance, the inner conductor 24 extending from the top of the balun is coupled (connected) to a quarter-wave hollow metal tube 29.

Figure 3A:
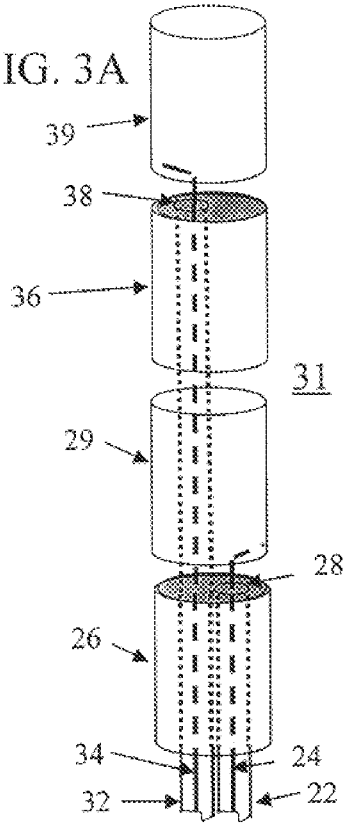
FIG. 3A illustrates multiple "tube" dipole antennas with several hollow metal tubes substantially concentrically formed in accordance with the present invention.

With this uniquely designed tubular dipole antenna, multiple antennas could be substantially concentrically formed within, above or below each other, giving a antenna designer many different options in antenna design for multiple applications and requirements. Referring to FIG. 3A, a multiple tubular dipole antenna 31 is shown. It should be understood that although antenna 31 (and 33 and 35) are referred to in the singular, they are truly multiple antennas. As with the tubular dipole 30 of FIG. 3, the antenna 31 comprises a coaxial cable 22 having and an inner conductor 24 and an outer conductor both running vertically and substantially concentrically through a quarter-wave metal sleeve 26. The antenna 31 further comprises a shorted end 28 formed from the connection of the outer conductor of the coaxial cable 22 to an end of the quarter-wave metal sleeve 26. Additionally, a quarter-wave hollow metal tube 29 is connected to the inner conductor 24 of the coaxial cable extending from the end of the quarter-wave metal sleeve 26. As suggested, a tubular dipole antenna within contemplation of the present invention could have multiple antennas. As shown in FIG. 3A, an additional dipole antenna is configured substantially concentrically above the quarter-wave hollow metal tube 29 using another quarter-wave metal sleeve 36 and hollow metal tube 39. The antenna 31 further comprises a shorted end 38 formed from the connection of the outer conductor of the coaxial cable 32 to an end of the quarter-wave metal sleeve 36. The hollow metal tube 39 is connected to the inner conductor 34 of the coaxial cable 32 extending from the end of the quarter-wave metal sleeve 36. It should be understood that several hollow tubes and metal sleeves could be configured in a similar fashion to provide multiple substantially concentric antennas that can be vertically stacked or even placed (or partially placed) within each other. In this instance, only two antennas are shown for simplicity.

Figure 3B:
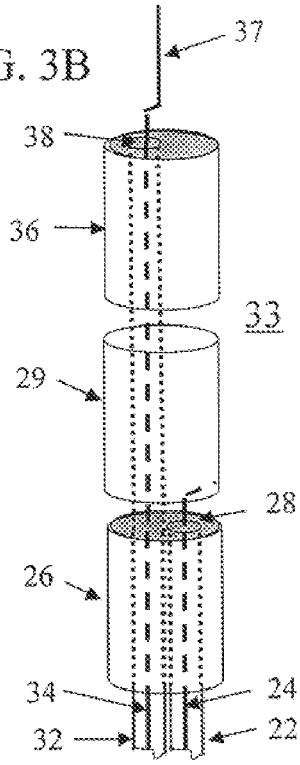
FIG. 3B illustrates another multiple "tube" dipole antenna (s) with a hollow metal tube substantially concentrically formed in accordance with the present invention.
Figure 3C:
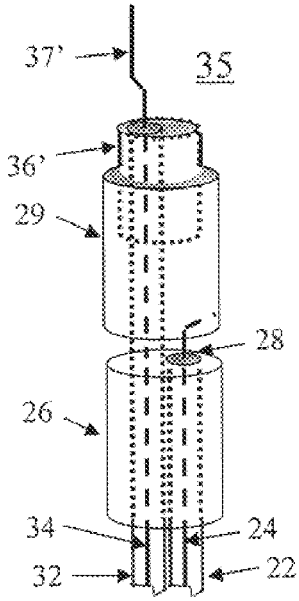
FIG. 3C illustrates yet another multiple "tube" dipole antenna(s) with a hollow metal tubes substantially concentrically formed in accordance with the present invention.

In FIG. 3B, antenna 33 illustrates a similar embodiment to the antenna 31 of FIG. 3A, except that the hollow metal tube 39 is replaced with the extension 37 serving as a monopole. In FIG. 3C, antenna 35 illustrates yet another similar embodiment to the antenna 33 of FIG. 3B, except that the metal sleeve 36' is shown with a slightly smaller diameter than the quarter-wave metal sleeve 36 of FIG. 3B. Furthermore, the metal sleeve 36' is placed partially within the hollow metal tube 29 as opposed to being external thereto.

This could be useful with antennas of different frequencies and/or where space constraints are a consideration.

Once again, it should be understood that the design of a multiple tubular antenna might vary drastically, yet still be in contemplation of the present invention as claimed. For instance, the metal sleeve 36' could reside partially within tube 29 as shown or completely within tube 29 or completely external thereto. In conjunction, the extension 37' may vary in length based on the configuration and frequency requirements. It should also be understood that the antenna in accordance with this aspect of the present invention could be used for multiple applications. For example, one antenna could be configured for cellular use at one frequency and another antenna configured for receiving GPS signals at another frequency and yet a third antenna could be configured to receive signals from a terrestrial repeater at yet another frequency.

Figure 5:
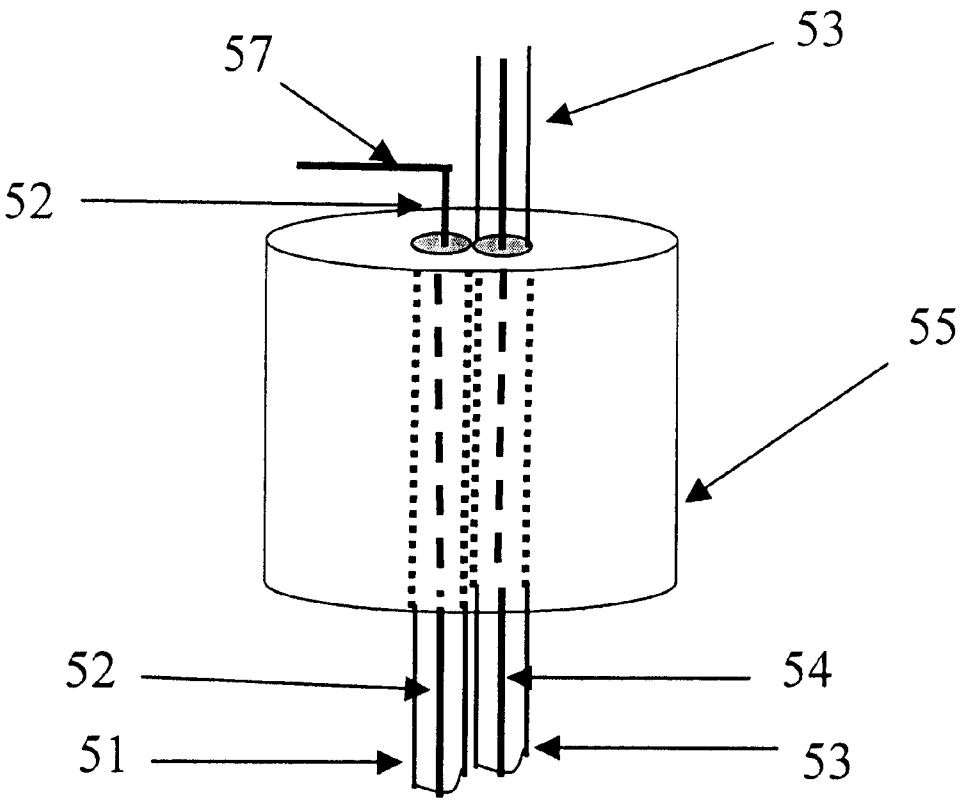
FIG. 5. is a diagram illustrating a balun in accordance with the present invention.

Thus, in accordance with the present invention and referring to FIG. 4 again, a coaxial cable 46 is passed through the new tubular dipole (FIG. 3) with minimum effect on its performance. This coaxial cable 46 is connected to the feed network 48 of the quadrifilar helix antenna 49. More design details are shown in FIG. 5 illustrating a balun 50. The balun 50 preferably comprises the coaxial cable 53 for the quadrifilar helix antenna having an inner conductor 54 that will couple to the feed network of the quadrifilar. The balun also preferably comprises another coaxial cable 51 having an inner conductor 52. Both coaxial cables 51 and 53 run vertically and concentrically through the quarter-wave metal sleeve 55 shorted at one end forming the balun. Both outer shields of coaxial cables 51 and 53 are connected together and also connected to the shorted end of balun 50. The balun 50 finally includes an extension 57 of the inner conductor 52 that will form the quarter-wave extension of the dipole. It should be noted that the quarter-wave extension can be formed in multiple forms as illustrated by FIGS. 4–7. In FIG. 4, a quarter-wave hollow metal tube is connected to form the quarter-wave extension. It should be noted that the quarter-wave extension is not necessarily one quarter-wavelength long. Other physical lengths can be used in order to make the antenna efficient, resulting in a desired radiation pattern.

Figure 6:
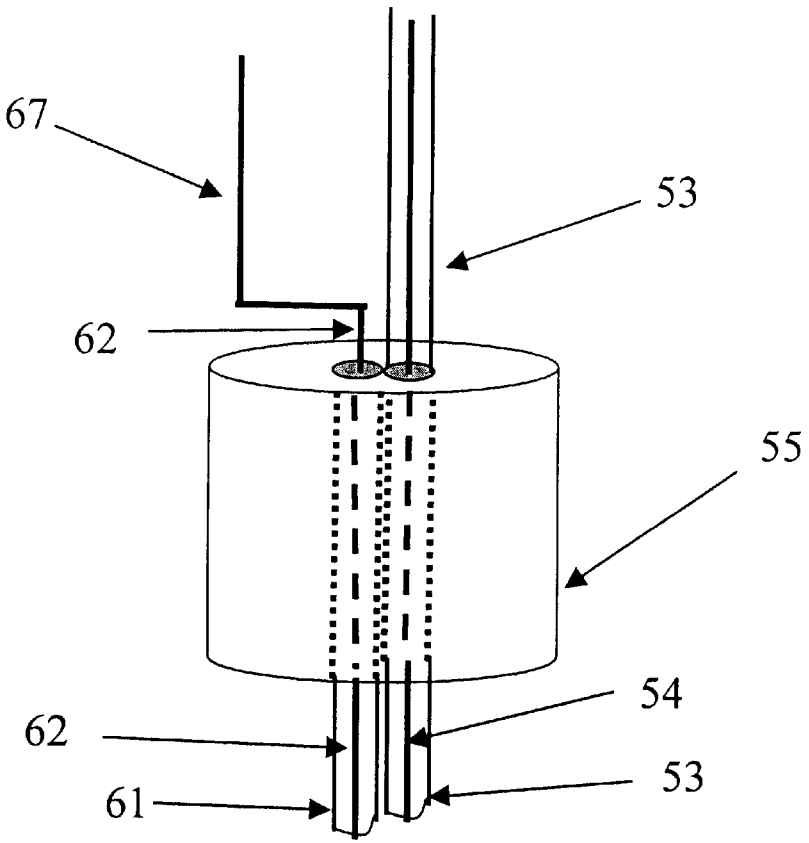
FIG. 6 is a diagram illustrating a first alternative implementation of the combination of a quadrifilar and dipole antenna in accordance with the present invention.
Figure 7:
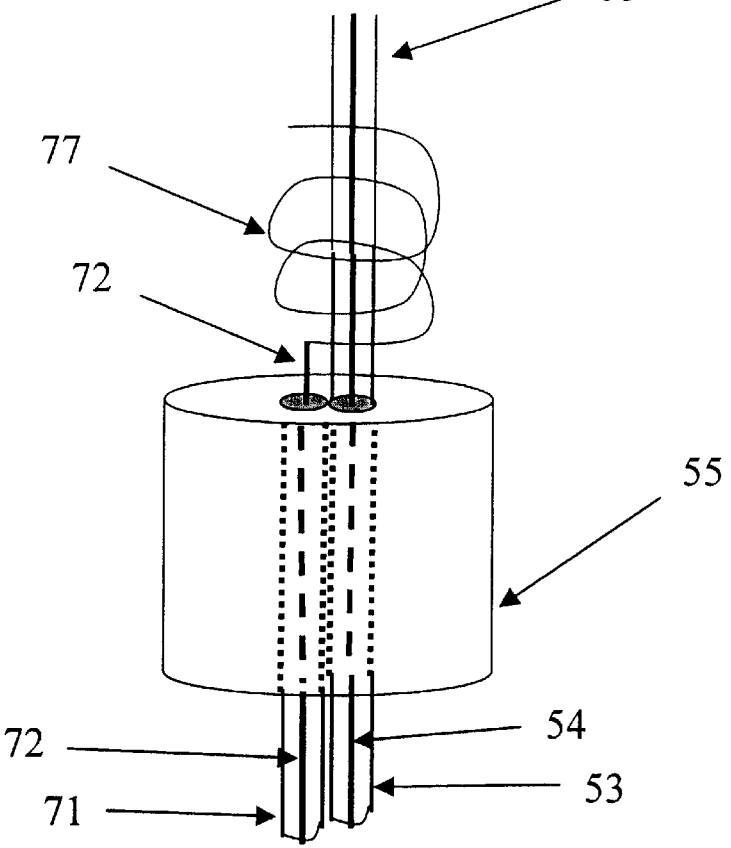
FIG. 7 is a diagram illustrating a second alternative implementation of the combination of a quadrifilar and dipole antenna in accordance with the present invention.

In a first alternative embodiment as shown in FIG. 6, a balun 60, similar to balun 50 of FIG. 5, shows a coaxial cable 61 having an inner conductor 62 connected to a quarter-wave extension 67. Extension 67 is running vertically parallel with coaxial cable 53 at a predetermined distance or a predetermined radius away. In this case, the dipole radiation pattern will be skewed due to the presence of coaxial cable 53. However, the average gain over the horizon is close to that of a dipole tested in free field. In an second alternative embodiment as shown in FIG. 7, a balun 70, similar to balun 50 of FIG. 5, shows a coaxial cable 71 having an inner conductor 72 that is isolated from the center conductor 54 of the coaxial cable 53, and is preferably connected to a helix extension 77. The helix extension 77 forms a radiator portion in the form of a helix a predetermined distance about the center conductor 54 of the coaxial cable 53 as shown.

Figure 8:
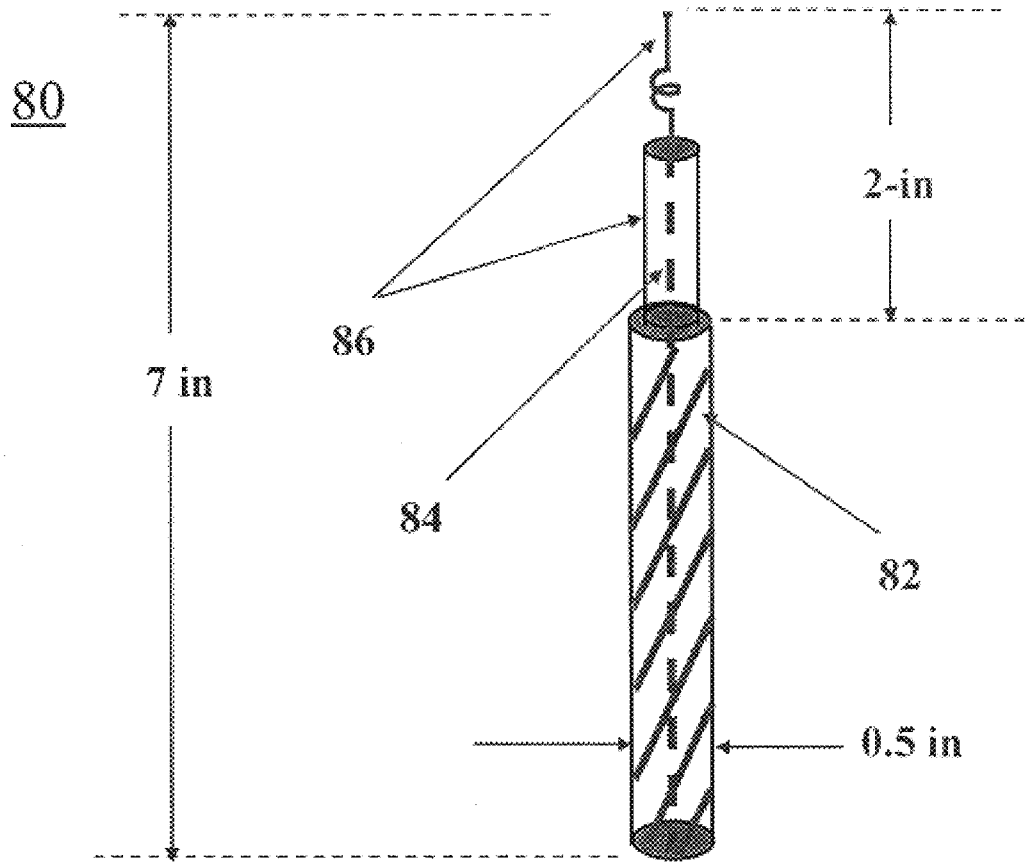
FIG. 8 is a diagram illustrating a third alternative implementation of the combination of a quadrifilar and dipole antenna in accordance with the present invention.

Referring to FIG. 8, a third alternative embodiment of the present invention is shown. A combination dipole/ quadrifilar helix antenna 80 preferably comprises a quadrifilar antenna 82 having a first coaxial cable (not shown) and a dipole antenna 86 external to the quadrifilar antenna 82 and having a second coaxial cable 84. A center conductor of the second coaxial cable 84 is isolated from a center conductor of the first coaxial cable and the second coaxial cable runs substantially concentrically through the quadrifilar helix antenna 82. In this instance, the dipole antenna 86 is preferably arranged vertically above the quadrifilar helix antenna at some distance away (not shown).

In summary and with reference to FIGS. 4–8, a combination antenna 40 comprises a quadrifilar antenna 49 and a linearly polarized antenna 44 vertically aligned and external to each other having a first coaxial cable 46 running substantially concentric within at least a portion of the combination linearly polarized antenna 44 and quadrifilar helix antenna 49 serving as a coaxial feed to a quadrifilar feed network 48 for the quadrifilar antenna and further having a second coaxial cable 42 running substantially concentric within at least a portion of the combination linearly polarized antenna and quadrifilar helix antenna 40 and serving as a quarter-wave extension for the linearly polarized antenna 44. As previously noted, the linearly polarized antenna can be a dipole antenna, a loop antenna, or a patch antenna or any other suitable linearly polarized antenna. It should be noted that the dipole antenna can be arranged vertically below or vertically above the quadrifilar helix antenna. When the dipole antenna is placed below, it is particularly advantageous for the quadrifilar helix in terms of providing greater exposure to line of sight reception of satellite signals. It should also be noted that the center conductor of the second coaxial cable is isolated from a center conductor 54 of the first coaxial cable 53 in several different ways. As shown in FIGS. 3 and 4, the center conductor of coaxial cable for the dipole antenna (the second coaxial cable) is isolated from the center conductor of the coaxial cable for the quadrifilar (the first coaxial cable) by coupling a quarter-wave hollow metal tube (29) to the center conductor of the second coaxial cable. As shown in FIG. 6, the center conductor 62 of the second coaxial cable 61 is isolated from a center conductor 54 of the first coaxial cable 53 by coupling a quarter-wave extension 67 of the center conductor of the second coaxial cable a predetermined radius away running vertically parallel from the center conductor of the first coaxial cable. In yet another embodiment that provides isolation between the antennas, a helix extension of the center conductor of the second coaxial cable forms a quarter-wave extension by forming a helix about the center conductor of the first coaxial cable as shown in FIG. 7. Although it is preferable that the coaxial cables in the various embodiments run vertically and concentric to the cavities of the quadrifilar and/or linearly polarized antennas, it should be noted the coaxial cables may also run substantially concentric thereto and still provide excellent performance as contemplated within the scope of the present invention. Finally, it should be noted that the embodiments described herein should not limit the scope of the invention. For example, it should be noted that the quadrifilar antenna in accordance with the present invention can be tuned to receive signals not only for Satellite Digital Audio Radio System-(SDARS) signals, but also global positioning satellite signals, or other suitable satellite signals. Likewise, the linearly polarized antenna in accordance with the present invention can be tuned to receive not only signals from SDARS terrestrial repeaters, but also cellular signals, paging signals, FM radio signals, AM radio signals, or other suitable signals for reception by the linearly polarized antenna.

The description above is intended by way of example only and is not intended to limit the present invention in any way except as set forth in the following claims.

What is claimed is:

1. A combination linearly polarized antenna and quadrifilar helix antenna, comprising:

a quadrifilar antenna having a first coaxial cable; and an antenna with linear polarization external to the quadrifilar antenna and having a second coaxial cable, wherein a center conductor of the second coaxial cable is isolated from a center conductor of the first coaxial cable and the first coaxial cable runs substantially concentrically through the antenna with linear polarization.

2. The combination antenna of claim 1, wherein the antenna with linear polarization is selected from the group comprising a tubular dipole antenna, a loop antenna, or a patch antenna.

3. The combination of claim 2, wherein the tubular dipole is arranged vertically below the quadrifilar helix antenna.

4. The combination antenna of claim 1, wherein the center conductor of the second coaxial cable is isolated from the center conductor of the first coaxial cable by coupling a quarter-wave hollow metal tube connected to the center conductor of the second coaxial cable.

5. The combination antenna of claim 1, wherein the center conductor of the second coaxial cable is isolated from the center conductor of the first coaxial cable by coupling a quarter-wave extension of the center conductor of the second coaxial cable a predetermined radius away running vertically parallel from the center conductor of the first coaxial cable.

6. The combination antenna of claim 1, wherein the center conductor of the second coaxial cable is isolated from the center conductor of the first coaxial cable by creating a helix extension of the center conductor of the second coaxial cable by coupling a quarter-wave extension in the form of a helix about the center conductor of the first coaxial cable.

7. The combination antenna of claim 1, wherein the antenna further comprises a quarter-wave metal sleeve shorted at one end having the first and second coaxial cables running substantially concentric thereto.

8. The combination antenna of claim 1, wherein the center conductor of the second coaxial cable couples into a quadrifilar feed network on a bottom portion of the quadrifilar helix antenna.

9. A combination dipole and quadrifilar helix antenna, comprising:

a quadrifilar antenna having a first coaxial cable; and a dipole antenna external to the quadrifilar antenna and having a second coaxial cable, wherein a center conductor of the second coaxial cable is isolated from a center conductor of the first coaxial cable and the second coaxial cable runs substantially concentrically through the quadrifilar helix antenna.

10. The combination dipole and quadrifilar helix antenna of claim 9, wherein the dipole is arranged vertically above the quadrifilar helix antenna.

11. A combination linearly polarized antenna and quadrifilar helix antenna, comprising:

a quadrifilar antenna and a linearly polarized antenna vertically aligned and external to each other;

a first coaxial cable running substantially concentric within at least a portion of the combination linearly polarized antenna and quadrifilar helix antenna serving as a coaxial feed to a quadrifilar feed network for the quadrifilar antenna; and a second coaxial cable running substantially concentric within at least a portion of the combination linearly polarized antenna and quadrifilar helix antenna and serving as a quarter-wave extension for the linearly polarized antenna.

12. The combination antenna of claim 11, wherein the linearly polarized antenna is selected from the group comprising a dipole antenna, a loop antenna, or a patch antenna.

13. The combination antenna of claim 12, wherein the dipole antenna is arranged vertically below the quadrifilar helix antenna.

14. The combination antenna of claim 12, wherein the dipole is arranged vertically above the quadrifilar helix antenna.

15. The combination antenna of claim 11, wherein a center conductor of the second coaxial cable is isolated from a center conductor of the first coaxial cable by coupling a quarter-wave hollow metal tube connected to the center conductor of the second coaxial cable.

16. The combination antenna of claim 11, wherein a center conductor of the second coaxial cable is isolated from a center conductor of the first coaxial cable by coupling a quarter-wave extension of the center conductor of the second coaxial cable a predetermined radius away running vertically parallel from the center conductor of the first coaxial cable.

17. The combination antenna of claim 11, wherein a center conductor of the second coaxial cable is isolated from a center conductor of the first coaxial cable by creating a helix extension of the center conductor of the second coaxial cable by coupling a quarter-wave extension in the form of a helix about the center conductor of the first coaxial cable.

18. The combination antenna of claim 11, wherein the antenna further comprises a quarter-wave metal sleeve shorted at one end having the first and second coaxial cables running substantially concentric thereto.

19. The combination antenna of claim 11, wherein a center conductor of the second coaxial cable couples into a quadrifilar feed network on a bottom portion of the quadrifilar helix antenna.

20. The combination antenna of claim 11, wherein the quadrifilar antenna is tuned to receive signals selected from the group of global positioning satellite signals, Satellite Digital Audio Radio System (SDARS) signals, or other suitable satellite signals and the linearly polarized antenna is tuned to receive signals selected from the group of SDARS terrestrial repeater signals, cellular signals, paging signals, FM radio signals, AM radio signals, or other suitable signals for reception by the linearly polarized antenna.

21. A tubular dipole antenna, comprising:

a coaxial cable having an inner conductor and an outer conductor both running vertically and substantially concentrically through a quarter-wave metal sleeve;

a shorted end formed from the connection of the outer conductor of the coaxial cable to an end of the quarter-wave metal sleeve;

a quarter-wave hollow metal tube connected to the inner conductor of the coaxial cable extending from the end of the quarter-wave metal sleeve; and at least a second tubular antenna having a second coaxial cable running vertically and substantially concentrically through the quarter-wave metal sleeve, the quarter-wave hollow metal tube, and a second quarter-wave metal sleeve.

22. The tubular dipole antenna of claim 21, wherein the tubular dipole antenna further comprises at least a second tubular antenna configured to reside vertically above the tubular dipole antenna said second tubular antenna comprising a second coaxial cable running vertically and substantially concentrically through the quarter-wave metal sleeve, the quarter-wave hollow metal tube, and a second quarter-wave metal sleeve, wherein an outer conductor of the second coaxial cable is shorted to an end of the second quarter-wave metal sleeve and a second quarter-wave hollow metal tube is connected to an inner conductor of the second coaxial cable.

23. The tubular dipole antenna of claim 21, wherein the tubular dipole antenna further comprises at least a second tubular antenna configured to reside vertically above the tubular dipole antenna, said second tubular antenna comprising a second coaxial cable running vertically and substantially concentrically through the quarter-wave metal sleeve, the quarter-wave hollow metal tube, and a second quarter-wave metal sleeve, wherein an outer conductor of the second coaxial cable is shorted to an end of the second quarter-wave metal sleeve and an extension forming a monopole is connected to an inner conductor of the second coaxial cable.

24. The tubular dipole antenna of claim 21, wherein the tubular dipole antenna further comprises multiple antennas configured substantially concentrically within the quarter-wave hollow metal tube using other smaller metal sleeves having diameters smaller than the quarter-wave hollow metal tube and wherein the multiple antennas are tuned to at least two frequency bands.

* * * * *